US005375783A

United States Patent [19]

Gamblin

[11] Patent Number: 5,375,783

[45] Date of Patent: * Dec. 27, 1994

[54] PLANETARY GRINDING APPARATUS

[76] Inventor: Rodger L. Gamblin, 8 Springhouse Rd., Dayton, Ohio 45409

[ * ] Notice: The portion of the term of this patent subsequent to Apr. 27, 2010 has been disclaimed.

[21] Appl. No.: 55,574

[22] Filed: May 3, 1993

[51] Int. Cl.[5] ..... B02C 17/08

[52] U.S. Cl. ..... 241/175

[58] Field of Search ..... 241/137, 171, 172, 175, 241/153

[56] References Cited

U.S. PATENT DOCUMENTS

| | | |
|---|---|---|
| 405,810 | 6/1889 | Wegmann . |
| 458,662 | 9/1891 | Pendleton . |
| 569,828 | 10/1896 | Herzfeld . |
| 1,144,272 | 6/1915 | West . |
| 1,951,823 | 3/1934 | Eppers . |
| 2,209,344 | 7/1940 | Matthews . |
| 2,387,095 | 10/1945 | Shidler . |
| 2,874,911 | 2/1959 | Limb . |
| 2,937,814 | 5/1960 | Joisel . |
| 3,190,568 | 6/1965 | Freedman et al. . |
| 3,513,604 | 5/1970 | Matsunaga . |
| 3,529,780 | 9/1970 | Wilkinson, Jr. . |
| 3,876,130 | 4/1975 | Block . |
| 4,057,191 | 11/1977 | Ohno . |
| 5,029,760 | 7/1991 | Gamblin . |
| 5,205,499 | 4/1993 | Gamblin . |

FOREIGN PATENT DOCUMENTS

| | | |
|---|---|---|
| 1089428 | 11/1980 | Canada . |
| 1088571 | 6/1952 | France . |
| 260777 | 2/1912 | Germany . |
| 1097790 | 1/1961 | Germany . |
| 593777 | 10/1947 | United Kingdom . |

*Primary Examiner*—Mark Rosenbaum
*Assistant Examiner*—Frances Han

[57] ABSTRACT

An improved planetary grinding apparatus is described that comprises a grinding tube holder that carries removable grinding tubes. The grinding tube holder undergoes planetary rotation and simultaneously contra-rotates at the same rate about its own axis so as to have no net rotation with respect to the base of the machine. The grinding tube holder is rigid and has no supporting or other structures around it in the space between its ends. As a result of this feature, and because of the lack of rotation of the grinding tube holder, each grinding tube may be interconnected with fixed external connectors without the use of rotating seals.

7 Claims, 3 Drawing Sheets

PLANETARY GRINDING APPARATUS

RELATED PREVIOUS INVENTIONS

In U.S. Pat. No. 5,029,760, issued Jul. 3, 1991, and U.S. Pat. No. 5,205,499, issued Apr. 27, 1993, I describe various configurations of planetary grinding systems that have the capability of being continuously fed without the use of rotating seals. This invention is an improvement upon such devices.

BACKGROUND OF THE INVENTION

1. Field of the Invention

This invention relates to the field of grinding or comminution and dispersion and more particularly to the reduction of solid matter into fine particles.

The reduction of solid matter into fine powders is a major task of an industrial society. As an example Portland cement is made from finely ground limestone, clay or shale, sand, and coal or other fuel. The limestone, clay or shale, and sand are subjected to a thermal process in which the heat is derived from the coal and the results are clinkers of material that must again be ground to produce the cement. Gypsum, after claching, must be ground to produce sheet rock and other such products.

The food industry grind many products including wheat, corn, rice, spices, sugar, and even chocolate. Paints, inks, and so forth use ground pigments and in turn undergo a dispersion process to disperse the ground pigment in a suitable vehicle.

Ceramics are made from finely ground materials. Generally the better the grind the better the ceramic product. Metals are ground as part of powder metallurgy and to prepare metallic pigments.

2. Description of the Prior Art

One of the oldest and simplest methods of grinding materials to fine powders uses a ball mill that generally consists of a horizontal cylindrical chamber that may be of any size. Ball mills have been constructed in sizes of up to eighteen feet in diameter by thirty or forth feet long.

For many applications that ball mill is about half full of steel or ceramic balls in addition to the material to be ground. The balls roll over one another and aid in the grinding process.

In cases where the material to be ground, such as a paint, consists of a fine pigment to be dispersed, the balls, usually called the grinding media, are essential to the process while in other cases such as the grinding of cement clinker, the media is omitted. In this latter case the larger clinkers act as media for the smaller ones and a means is usually provided for extracting only the finer particles from the mill.

While the ball mill is effective and reliable, it tends to be large and slow. The physical size of the mill tends to cause it to be high in capital cost for the amount of work done.

There is much art having to do with overcoming the deficiencies of the ball mill. Alternative approaches to the task of grinding include mills wherein a material is stirred with media by means of mandrels. In another approach the material being ground in a liquid carrier is subjected to high shear rates by high speed blades or by being forced through narrow gaps between rapidly moving surfaces. These devices are most useful for dispersion while a ball mill both grinds and disperses.

In yet other attempts to obtain the benefits of a ball mill while overcoming its deficiencies, considerable prior art has addressed planetary mills in which the grinding chamber is orbited about an axis parallel to the axis of the grinding chamber. In such art the planetary motion imparts a centrifugal force that aids the action in the grinding chamber.

For example, Wegmann in U.S. Pat. No. 405,810 discloses an orbiting mill driven by planetary gears so as to produce centrifugal forces to aid in the grinding. While well adapted to a batch process, the Wegmann device precludes direct attachment of input and output tubes.

Another form of planetary mill is disclosed in Pendleton, U.S. Pat. No. 458,662. Due to the necessary supporting framework, the feed to the mill is required to pass through the machine axis by means of a rotating seal. A similar rotating seal feed is required by Hertzfeld in U.S. Pat. No. 569,828 which describes vertically oriented orbiting grinding chamber.

West in U.S. Pat. No. 1,144,272 describes a multiple grinding tube centrifugal mill having a planetary gear drive. Access to the grinding tubes is provided by doors on the side of the tubes thus permitting only batch operating processes. Eppers in U.S. Pat. No. 1,951,823, like Pendleton and Hertzfeld above, discloses an axial feed with rotating seals for a planetary mill.

Matthews in U.S. Pat. No. 2,209,344 discloses a planetary rock crusher employing bars as the grinding media. Ore is fed into the mill at its axis and then circulated through the several planetary grinding chambers. Shideler et al., in U.S. Pat. No. 2,387,095, discloses a multiple tube planetary polishing or abrading machine equipped with a fixed eccentric to maintain the tubes in a fixed orientation relative to ground. The tubes are individually closed with stoppers to permit only batch operation.

Limb, in U.S. Pat. No. 2,874,911, discloses a planetary ball mill wherein the grinding chamber rotates more rapidly about its own axis than it does about its orbital axis, thereby limiting its operation to a batch process.

Joisel, in U.S. Pat. No. 2,937,814, discloses a planetary ball mill having two forms. The first form describes a discontinuous or batch process while the second form shows a continuous grinding process using rotary seals at the inlet and outlet. Separate motors are provided to drive the mixing chambers and to provide the orbital motion so that the relative speeds may be varied.

Matsunga et al., in U.S. Pat. No. 3,513,604, discloses a planetary polishing machine having a variable ratio of the orbital rotation rate to grinding chamber rotational rate so as to necessitate a batch process. Wilkinson, Jr., in U.S. Pat. No. 3,529,780, discloses a continuously fed planetary grinding mill having an intermittent discharge into a curved trough.

Bloch, in U.S. Pat. No. 3,876,160, describes a centrifugal mill wherein the grinding chambers and orbital motion are separately controlled. Alternatively, the grinding chamber axis may be parallel to the orbital axis, perpendicularly to the orbital axis, or varied respective to the radius of the planetary movement. However, in all cases a batch operation is contemplated.

Freedman et al., in U.S. Pat. No. 3,190,568, discloses a cell disintegrating apparatus for batch or continuous operation in which the disintegrating tube is rapidly oscillated in a direction perpendicular to its axis to shake and abrade cellular material. Ohno, in U.S. Pat.

No. 4,057,191, discloses a grinding mill having a grinding tube with one end mounted in a spherical bearing while the other end is moved in a circular path by a rotating crank so as to make a hybrid form of planetary mill.

German patent 260,777 (1913) discloses a planetary ball mill having a toroid-shaped grinding chamber wherein the grinding chamber radius is significantly greater than the planetary or orbital motion radius. Both the feed and discharge are gravity controlled.

German patent 1,097,790 (1961) discloses a planetary crushing mill for granulated solid material suspended in a liquid wherein the rotation of the grinding chamber is independent of the planetary or orbital motion, thus requiring rotating seals at the inlet and outlet of the grinding chamber.

British patent 593,777 (1947) to Benham discloses a planetary grinding mill in which a spheroidal grinding chamber is orbited about a vertical axis and simultaneously oscillated about its own axis. The spheroidal grinding chamber is supported from one end in a pivoted bearing so that variations in the centrifugal force due to the quantity of material being ground can be used to control the feed rate to the grinding chamber. Material exits the grinding chamber through a mesh screen so as to provide control over the size of grind. In order to make the classification scheme work properly it is essential to the Benham patent that the grinding chamber have a vertical axis.

Canadian patent 1,089,428 (1980) discloses a planetary grinding mill driven by a pair of eccentrics such that the orbiting radius is small compared with the grinding chamber radius so as to provide "a continuous operation in the sub critical range at a high grinding rate per unit of volume of the grinding drum . . . " (page 1, 11. 22–23).

French patent 1,088,571 (1955) discloses a planetary grinding mill driven by pairs of counterbalanced cranks connected by a pair of crossarms to which one or more grinding chambers are affixed.

In U.S. Pat. No. 5,029,760 I describe a system wherein a rotatable drum assembly carries two rotatably mounted grinding tubes that are constrained to have no net rotation with respect to the base of the machine. Access to the grinding tubes may be made only to their ends and only one of the two grinding tubes may be addressed from either end. A second embodiment uses a series of four rotating wheels that drive two oppositely mounted frames that each carry one or more grinding tubes.

In U.S. Pat. No. 5,205,499 I describe a rotatable drum assembly that carries a single grinding tube that has advantages of permitting access to the grinding tube from both ends.

SUMMARY OF THE INVENTION

In the present invention I describe a cylindrical grinding tube holder wherein the holder undergoes planetary motion and is itself constrained so that it has no net rotation with respect to the system base. The holder carries one or more grinding tubes that have their axes parallel to the axis of the holder.

In the case of the instant invention, as opposed to my previous inventions, there is at least a portion of the grinding tube holder that is free standing, that is, it has no surrounding support structure of any kind. It is, instead, free in the sense that it is the only object directly connected to the base apparatus (the grinding tubes and their interconnections directly connect only to the grinding tube holder and not the base apparatus, and thus are not included) contained between two parallel planes, each perpendicular to the axis of the grinding tube holder, and separated from each other by a significant distance.

As will be discussed in more detail below this arrangement permits access to the grinding tube holder by means of flexible tubes that can be connected solidly at one end external to the apparatus and at the other end solidly to the grinding tubes held by the grinding tube holder. In this context the word, "solidly", means that the flexible tube can be connected to a fixed solid pipe or tube by means of rigid or solid clamps that permit no rotation of sliding between the tube and the connection.

This kind of connection is achieved in conjunction with a grinding tube holder that undergoes smooth planetary motion, but that is constrained to have no net rotation itself. This motion is similar to that of devices I have previously described, but now, because the grinding tube holder is itself free standing, I can make multiple external connections anywhere along its length. Furthermore this capability is achieved without the rather awkward arrangement for motion depicted in my U.S. Pat. No. 5,029,760, FIG. 4.

The grinding tube holder of this invention can carry multiple grinding tubes axially mounted in the grinding tube holder. Furthermore these grinding tubes can be interconnected so as to make a series of tubes that, for example, successively subject material to different media that is carried in successive tubes.

Since the grinding tube holder can be a fixed part of the apparatus, with the grinding tubes held in place by this holder, a means is readily envisioned wherein the grinding tube, or tubes, may be removed from the grinding tube holder while the machine is stopped. Therefore, multiple grinding tubes may be used with a single machine so as to permit, for example, one machine to grind several colors in an ink making facility.

Another way of looking at the present invention is to note that it is a synthesis of concepts disclosed in my previous invention that produces a result that has the advantages of both kinds of device disclosed in these Patents without the disadvantages of either. Thus in U.S. Pat. No. 5,029,760 in FIG. 4, I presented a configuration wherein a number of free standing grinding tubes were used in conjunction with a set of oscillating end plates. The support structure for these plates is somewhat awkward to implement and oscillating forces exist in the structure that are difficult to balance.

Embodiments shown in U.S. Pat. No. 5,205,499 all have grinding tube cages that envelope the grinding tube with a support structure that permits access to the grinding tube from either end only. Thus through these latter devices work well from the standpoint of smooth operation (that is, no difficulty balancing oscillating forces) access to the grinding tubes is limited to one end, and only one tube in a device may be accessed from either end.

As will be seen in more detail below, the instant invention has the advantages of access of U.S. Pat. No. 5,029,760 with the advantages of uniformity of rotation of U.S. Pat. No. 5,205,499.

DETAILED DESCRIPTION OF THE INVENTION

In the case of a ball mill, it has long been known that grinding of material into a fine powder and homogeneous dispersion of fine powder can be obtained if the mill is operated for a sufficiently long time, e.g. 24 hours. Grinding results from the cascading of the balls against each other, the wall of the mill, and the material to be ground. Cascading of the balls results from the fact that the rotation of the cylindrical grinding chamber and the viscosity of the material to be ground tends to carry the balls up the walls of the grinding chamber until the force of gravity cause the balls and the material to be ground to flow. At high rotational speeds, the centrifugal forces developed overcome the gravitational forces developed, and neither cascading nor grinding occurs. The grinding power of a ball mill, which determines its capacity, is directly related to its size.

However, if the grinding chamber is orbited about an axis parallel to its own axis and rotted about its own axis in the opposite direction at a rate of one rotation per orbit, the grinding chamber will maintain a fixed orientation with respect to the machine base.

Figure 1:
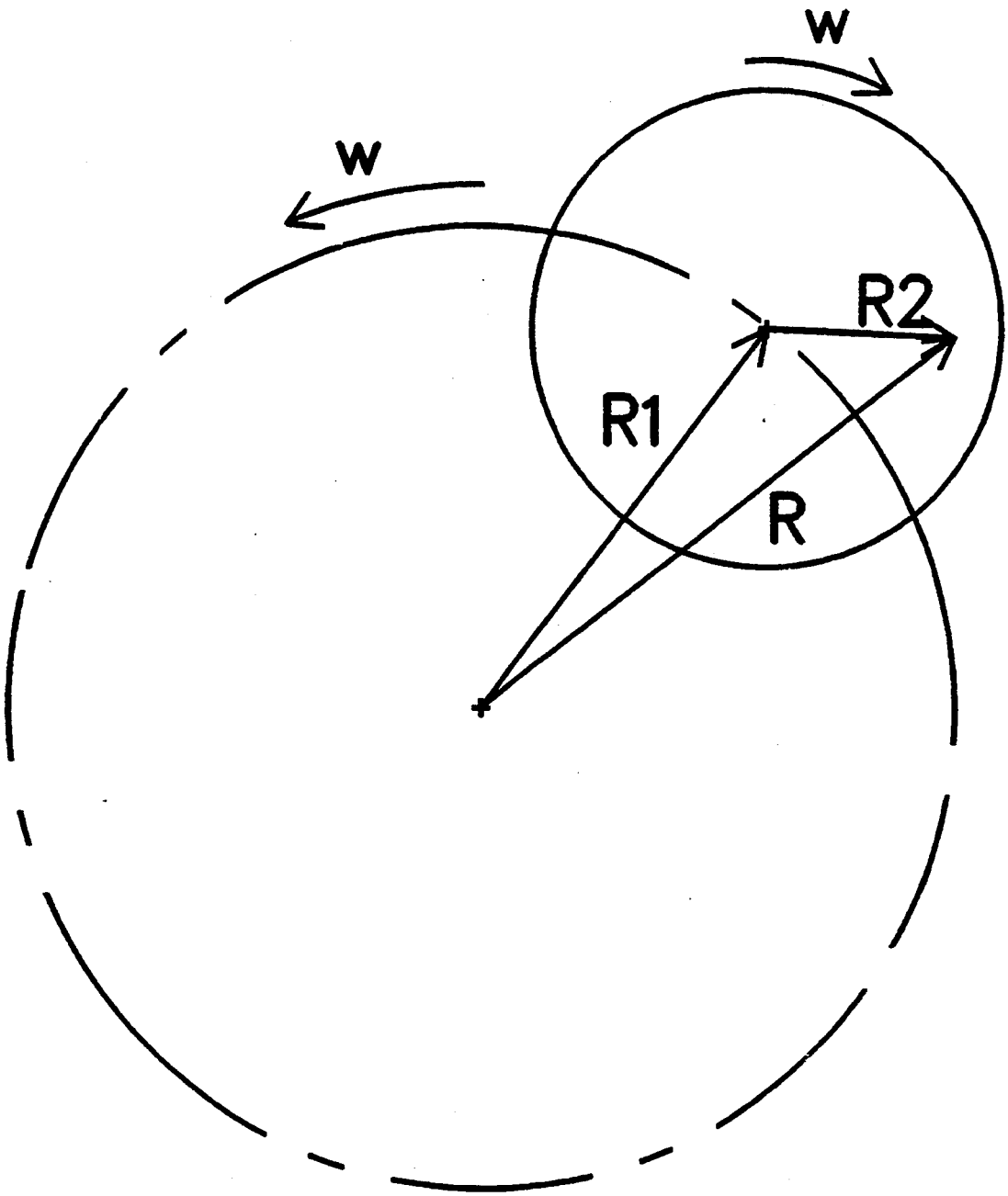
FIG. 1 is a diagram of the vectors that determine the location through time of an element of material moving with the grinding tube of a planetary mill.

The analysis of such a mill starts by defining three vectors which are diagramed in FIG. 1. The first is from the center of rotation of the planetary motion to the center of the grinding tube and is called R1. The second vector is any vector from the center of the grinding tube to any point on the grinding tube. This vector is R2. The third vector is the sum of R1 and R2 and thus is a vector from the center of the planetary motion to any point on the grinding tube. Symbolically R is given by R=R1+R2.

Let the second derivative of R with respect to time be taken when the mill is in operation. As observed above the grinding tube always maintains its orientation in space so that R2 does not vary with time. Both its first and second derivatives are thus zero, and the second derivative of R is the same as the second derivative of R1, which, in turn, is a vector of magnitude $w^2R1$ pointed toward the origin, where w is the rotational speed in radians per second. What all this means is that an element of material carried by the grinding tube and rotating with this tube experiences forces exactly as if it were in a gravitational field of magnitude $w^2R1$.

Thus in the case of the planetary mill, if we consider a frame of reference located in the grinding tube with the force, $w^2R1$, stationary in time and with its direction "down", we see that we are in a situation comparable to a ball mill. We have a uniform force field pointed downward, and a rotating cylinder perpendicular to the direction of this field.

In the case of a ball mill, it has been observed that the best grinding action takes place when the media in the mill is at about a 45 degree angle. This angle is observed when the ratio of force due to centrifugal force is about ½.15 that due to gravity. In the case of the planetary mill, the force that is comparable to gravity is given as $w^2R1$ while that comparable to the centrifugal force is given by $w^2R2$. In the case of a planetary machine we must again take the ratio of the centrifugal force to the equivalent of the gravitational force as ½.15 in order to maintain a 45 degree grinding angle. When this ratio is taken, however, the speed of rotation drops out and it can be seen that the condition for the 45 degree grinding angle is just that R1 and R2 be in the ratio of ½.15.

The fact that the rotation speed drops out means that the media angle in the mill is independent of rotation speed. Such a result is certainly desirable since, as opposed to a ball mill, the maximum speed of rotation and thus the grinding action is not limited by the force of gravity.

The power consumed by a such a centrifugal mill can be related to the energy expended in raising the media against the centrifugal force of the planetary rotation. Thus the power consumed by a Cyclomill is given by:

$$P=4.785\times10^{-2}\, d\, l\, w^3\, R1^4 \text{ watts}$$

$$(P=3.083\times10^{-9}\, d\, l\, (\text{rpm})^3\, R1^4 \text{ horsepower})$$

where R1 is the radius of planetary motion and is in meters (feet), L is the length of the grinding tube in meters (feet), d is the mill base density in kilograms per cubic meter (lbs. per cubic foot), w is the rotation rate in radians per second, and (rpm) is the rotation rate in rounds per minute.

The grinding power of a ball mill is directly related to the power consumed in its operation. In the same way the grinding power of a planetary mill is also given by the power consumed in its operation. The grinding power of a planetary mill having a single 5.6 inch diameter grinding chamber and a length of 2.0 feet orbiting at 1000 rpm on an orbital diameter of 1.0 foot and employing 1/16 inch diameter balls is about the same as that of a conventional ball mill four feet in diameter and eight feet long rotating at 21 rpm and employing ⅜ inch diameter balls.

What has been achieved is the power to grind large quantities of material in a small apparatus. The capital cost of the device is reduced, but the flexibility is greatly increased. For example suppose a ball mill is being used to make black ink and it is desired that yellow ink be produced instead. In the case of a ball mill a very large quantity of media must be washed free of black ink to accomplish the task. In the case of a planetary mill only a small volume need be cleaned. A practical alternative exists in the case of the planetary mill to have two grinding tubes, one for yellow and one for black. Such an alternative is, of course, not practical with a ball mill.

Figure 2:
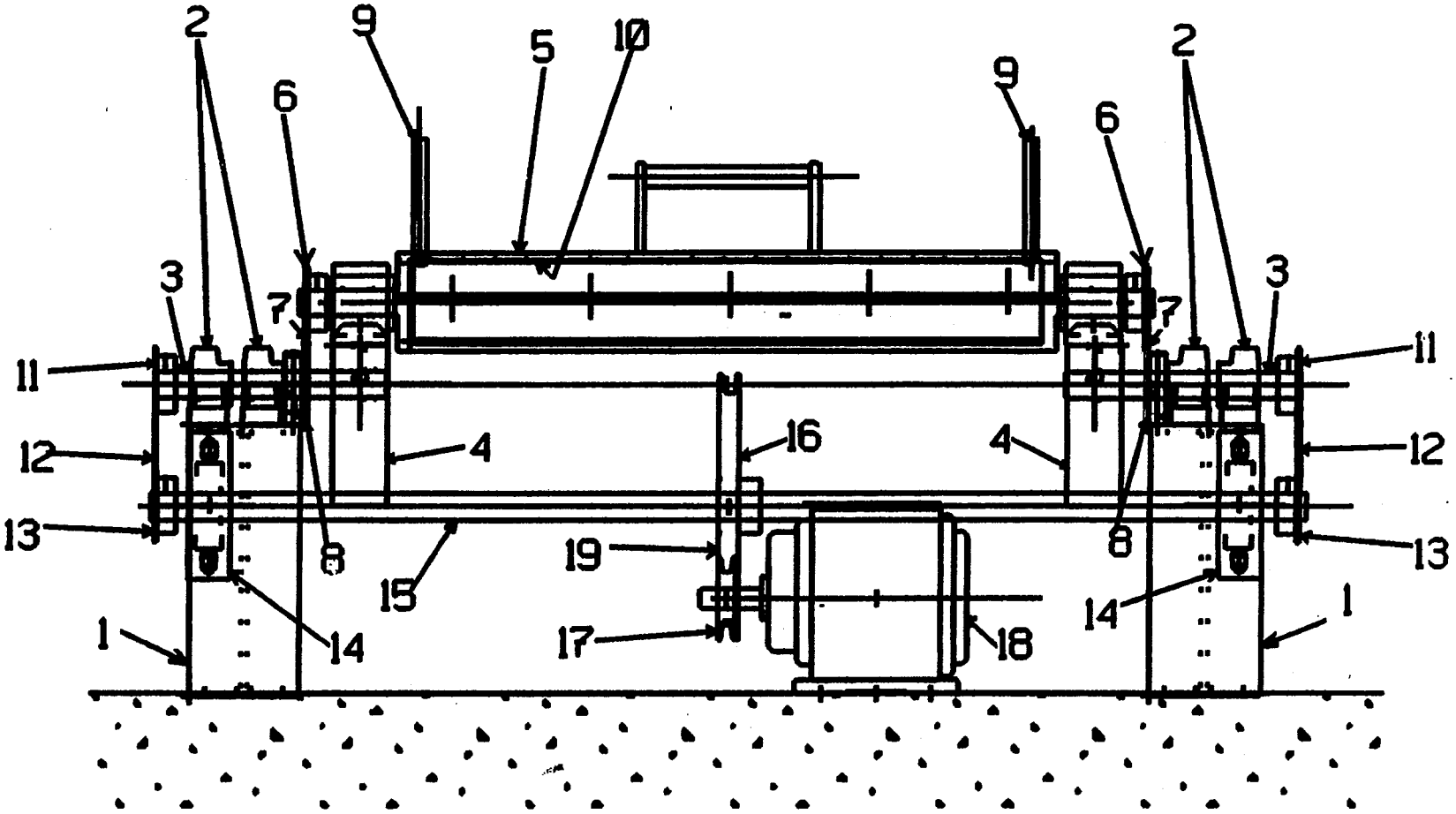
FIG. 2 is a side view of an apparatus that embodies the principles of this invention.
Figure 3:
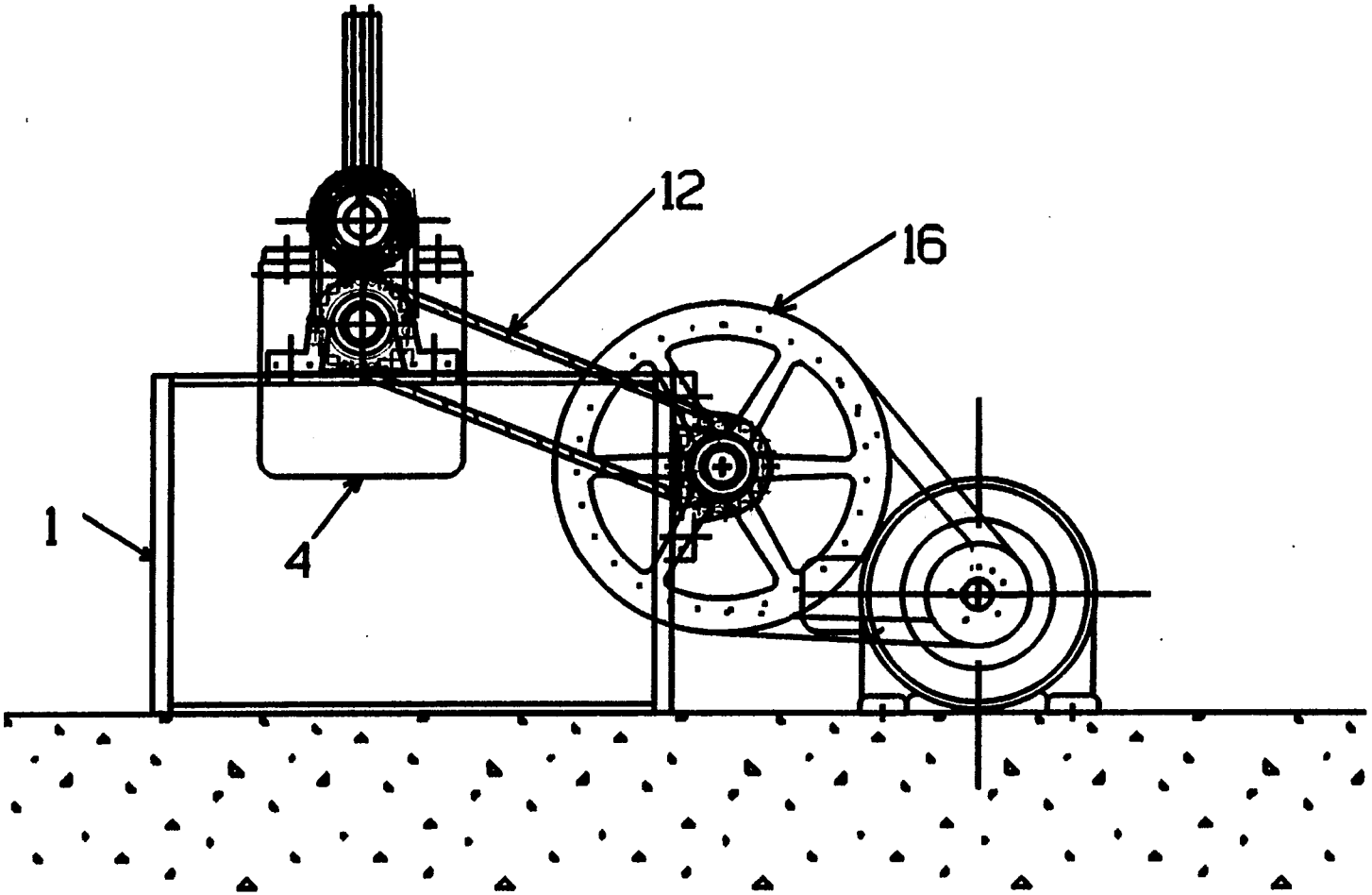
FIG. 3 is an end view of this same apparatus.

Reference is now made to FIGS. 2 and 3 which represent side and end views of one embodiment of the instant invention. End supports, 1, which are placed rigidly upon a fixed datum, support bearings, 2, that rotatably mount shafts, 3. Shafts, 3, connect rigidly to and carry rotors, 4, that, in turn, are rotatably mounted to grinding tube holder, 5. The ends of grinding tube holder, 5, project through the rotors, 4, and are rigidly connected to sprockets, 6, that in turn are interconnected by means of chains, 7, to sprockets, 8. Sprockets, 8, are rigidly connected to base, 1. By this means as the rotor rotates so as to impart planetary motion to the grinding tube carrier, the grinding carrier is constrained by sprockets 6 and 8, interconnected by means of chain, 7, to contra-rotate about its own axis at the same rate and opposite in sense to the planetary rotation of the grinding tube.

This combination of motions results in access tubes, 9, to the grinding tube, 10, which is rigidly mounted in the grinding tube holder, remaining in a vertical orientation as the grinding tube holder undergoes planetary rotation. The ends of the access tubes undergo the circular motion of the planetary rotation, but do not twist about their own axes, and as noted above, always point up. These tubes may be connected rigidly to external flexible tubes (not shown) that in turn rigidly connect to the external environment.

It is to be noted that the grinding tube holder is free standing, in the sense described above, for the totality of space defined between the facing planes of the rotors, 4. It can also be seen that if a tube or object is placed in this region and connected to the base machine, it will tend to interfere with the motion of the grinding tube holder or the external connections from the grinding tube or both. The grinding tube cage used in my previous inventions thus caused such interferences so that connections of the kind shown in FIGS. 2 and 3 were precluded.

Shafts, 3, are driven by sprockets, 11, that in turn are driven by chains, 12, that in turn are driven by sprockets, 13. Sprockets, 13, are rigidly mounted upon jackshaft, 15, that is, in turn, driven by sheave, 16. Sheave, 16, is driven by belt, 19, that is driven by sheave, 17, that in turn is driven by motor, 18. The ratio of the size of sheave, 18, to sheave, 16, is selected to provide for an optimum rotation speed of the mill for a standard motor speed.

It is, of course, to be realized that the particular arrangement of using a jackshaft for symmetrical drive to the two ends of the machine is a matter of design choice. Machines can be made to drive from one end only with some simplification of design, but possibly with reduced bearing life. A machine with only one bearing support is possible if the grinding tube holder is supported from one end only in a cantilevered arrangement. Again, such options are a matter of taste for a designer and one skilled in the art can readily make such modifications without changing the basic operating principles of the machine.

The grinding tube holder can readily carry more than one grinding tube. In the case of such a device the radius of each individual tube must be compared to the radius of planetary motion of the grinding tube holder axis to select an appropriate grinding angle. In particular, this ratio is about 2.15, but can be selected to range anywhere from between 1.2 and 4.0.

In essence, all parts of the grinding tube holder and the associated grinding tubes in the case of multiple grinding tubes move as a solid body. Complete freedom exists as to interconnection between various elements within the grinding tube holder and to fixed external connections. A set of six grinding tubes, for example, might be serially connected so as to form a sequence of interconnected chambers, or each grinding tube might be separately fed from external sources so as to form essentially size separate grinding systems in one device.

In my previous inventions I have shown details of various methods for restraining the rotation of the grinding tube holder so that it has no net rotation with respect to the base of the machine. The specific means selected with the design shown in FIGS. 2 and 3 is simple and compact for power levels under about ten horsepower. For higher powers, belts and gear systems know to designers familiar with such art can readily be substituted.

The grinding tube holder is intended to be a fixed part of the machine with one or more grinding tubes mounted within or upon its structure. The purpose is, of course, to provide flexibility for the repair or change of grinding tubes. It is possible to treat the grinding tube as integral with the grinding tube holder with some corresponding savings in cost, but at the expense of depriving a user of the system of flexible and easy replacement of a grinding tube.

In most cases the grinding tubes can readily be cooled by providing for sufficient flow of material through them or by allowing the air flow caused by the planetary motion to go directly around them, for example, by perforating the grinding tube holder. In some cases, however, it will be desirable to jacket the grinding tubes with coolant: water, for example. Such amenities may readily be provided for by sealing the grinding tubes in the grinding tube holders and circulating coolant between the grinding tubes and grinding tube holder walls. Connections for the coolant can be made in a similar manner to those for the material furnished to the grinding tubes for grinding.

What is claimed is:

1. An improved grinding apparatus comprising a base, two rotors rotatably supported on said base 1, for rotation about a single axis, said rotors rotatably supporting only each end of a grinding tube holder having an axis parallel to and offset from said axis of said rotors so that said grinding tube holder undergoes a planetary rotation about said axis, a means of preventing said grinding tube holder from rotating with respect to said base, a driving means drivingly interconnected with said rotors, and at least one grinding tube mounted coaxially to and supported by said grinding tube holder.

2. An improved planetary grinding apparatus according to claim 1 wherein the ratio of the radius of the planetary rotation of said grinding tube holder to the radius of said grinding tubes is between 1.2 and 4.0.

3. An improved planetary grinding apparatus according to claim 1 wherein said means of preventing rotation with respect to said base is a toothed, one-to-one interconnection between a toothed driving means rigidly connected to said grinding tube holder and a toothed driving means rigidly connected to said base.

4. An improved planetary grinding apparatus according to claim 1 wherein said grinding tubes are supplied with at least one feed tube and one discharge tube that interconnect with fixed external connectors by means of non rotating seals.

5. An improved planetary grinding apparatus according to claim 1 wherein there are exactly two oppositely mounted rotors that rotatably support said grinding tube holder.

6. An improved planetary grinding apparatus according to claim 5 wherein said rotors are symmetrically driven by means of a jackshaft that is, in turn, driven by said driving means.

7. An improved planetary grinding apparatus according to claim 1 wherein said grinding tube is made an integral part of and one with said grinding tube holder.

* * * * *